United States Patent [19]

Ishi et al.

[11] Patent Number: 4,865,293

[45] Date of Patent: Sep. 12, 1989

[54] HYDRAULIC JACK

[75] Inventors: Masayoshi Ishi; Yasuhiro Fuji, both of Gifu, Japan

[73] Assignee: Kayaba Kogyo Kabushiki Kaisha, Japan

[21] Appl. No.: 191,284

[22] Filed: May 6, 1988

[30] Foreign Application Priority Data

May 8, 1987 [JP] Japan ..... 62-112772

[51] Int. Cl.[4] ..... B66F 3/08

[52] U.S. Cl. ..... 254/2 R; 254/84; 254/DIG. 1

[58] Field of Search ..... 188/151 A, 67; 187/8.47, 8.49; 92/17, 18, 23; 254/2 R, 2 B, 93 R, 93 H, 84, 85, DIG. 1

[56] References Cited

U.S. PATENT DOCUMENTS

| | | | |
|---|---|---|---|
| 2,751,191 | 6/1956 | Schroeder | 254/2 R |
| 3,188,106 | 6/1965 | Vlinski | 254/2 R |
| 3,309,062 | 3/1967 | Jansz | 92/17 |
| 3,321,182 | 5/1967 | Elenburg | 92/18 |
| 3,362,351 | 1/1968 | Robertson | 254/84 |
| 3,779,399 | 12/1973 | Shigeno et al. | 254/84 |
| 4,013,267 | 3/1977 | Kirk | 254/85 |
| 4,149,451 | 4/1979 | Axelsson | 92/17 |

*Primary Examiner*—Robert C. Watson
*Attorney, Agent, or Firm*—McGlew & Tuttle

[57] ABSTRACT

A hydraulic jack, for lifting a heavy-weight structure such as a wing of an airplane, comprises a vertical primary cylinder, a ram vertically movably inserted in the primary cylinder, a lock nut threadedly mounted on an external thread of the ram, a first gear provided on the lock nut, a nut rotatably supported in a housing, a second gear provided on the nut and releasably meshing with the first gear of the lock nut, and a screw rod extending parallel to the ram and connected to the ram via a bracket. The screw rod has a second external thread and threadedly extends through the nut for vertical movement.

6 Claims, 10 Drawing Sheets

HYDRAULIC JACK

BACKGROUND OF THE INVENTION

1. Field of the Invention

The present invention relates to a hydraulic jack for use in lifting a heavy-weight structure, such as a wing of an airplane.

2. Description of the Prior Art

FIG. 11 of the accompanying drawings schematically shows a known hydraulic jack for lifting a relatively large heavy-weight structure, such as a wing of an airplane.

The jack comprises a cylinder 1, a ram 3 vertically movably inserted in the cylinder 1 via a piston 2, a plurality of legs 5 each connected to an upper portion of the cylinder 1 via a bracket 4, and a caster 6 connected to a lower portion of each of the legs 5 via a spring 7 normally urging the leg 5 upwardly.

To lift a heavy-weight structure, the jack is transported to a work position under a point of the structure to be supported, and the individual casters 6 and then moved little by little manually or by a lever until the ram 3 is vertically aligned with the point of the structure to be supported.

In the event that the surface of the ground on which the jack is to stand is slanted or irregular, the individual legs 5 are expanded and shrunk to finely adjust the length of the respective leg 5 until the top of the ram 3 reaches the undersurface of the structure.

After having thus made horizontal and vertical adjustments of the cylinder 2 and the ram 3, the ram 3 is expanded to raise the structure. To lower the structure, the ram 3 is shrunk to such an extent that the load of the structure does not exert on the ram 3. At that time the leg 5 and the cylinder 2 are slightly raised by the bias of the springs 7. Finally, the individual legs 5 are shrunk manually.

However, this prior jack is disadvantageous in that since the jack is transported horizontally to the work position manually or by a lever, positioning is laborous and time-consuming. Another disadvantage of the prior jack is that the individual legs 5 must be manually adjusted in length, which is laborious and time-consuming. The larger the jack is, the more labor power will be required which would result in a poor degree of working efficiency.

FIG. 12 shows another prior hydraulic jack. This jack comprises a cylinder 1', a ram 3' vertically movably inserted in the cylinder 1' via a piston 2', and a lock nut 5' threadedly mounted on a screw portion 4' of the ram 3' outside the cylinder 1'.

When the ram 3' is expanded, compressed oil is introduced into a lower pressure chamber 5' of the piston 2' via a port 6' to raise the ram 3' and the lock nut 5'.

To keep the height of the ram 3' at a predetermined level, the lock nut 5' is lowered from the phantom-line position to the solid-line position along the screw portion 4' so that the lower surface of the lock nut 5' contacts the upper surface of the cylinder head 1'a to lock the ram 3'.

To lower the ram 3', the lock nut 5' is rotated to move to the phantom-line position, and the compressed oil is extracted from the pressure chamber 7'. As a result, the ram 3' is lowered by gravity.

This prior jack also is disadvantageous in that since the ram is locked by rotating the lock nut threadedly mounted on the ram, it is necessary to rotate the lock nut every time the ram is to be raised or lowered, thus causing a poor degree of working efficiency. Further, since the lock nut is rotated by hand, it is dangerous to position the ram.

SUMMARY OF THE INVENTION

It is therefore a primary object of the present invention to provide a hydraulic jack which enables easy and accurate vertical adjustment, thus causing an improved degree of working efficiency.

Another object of the invention is to provide a hydraulic jack which enables easy and accurate vertical adjustment, thus causing an improved degree of working efficiency.

A further object of the invention is to provide a hydraulic jack in which locking and positioning of a ram can be performed automatically and which is easy to operate.

According to the present invention, a hydraulic jack comprises a platform car having a plurality of casters on its lower portion, and a jack body floatingly mounted on the platform car and having a plurality of legs, each of the casters being operatively connected to a drive cylinder. The jack body on the platform car can be vertically adjusted commensurate with the extent to which the drive cylinder is expanded or shrunk.

For horizontal adjustment, the hydraulic jack comprises a platform car, a jack body floatingly mounted on the platform car, and a pair of horizontal drive cylinders connected between the platform car and a cylinder. Each drive cylinder is disposed at a position where the drive cylinders cross each other.

For horizontal adjustment, the hydraulic jack in an alternative form comprises a platform car, a jack body floatingly mounted on the platform car, a pair of horizontal drive cylinders connected between the platform car and a cylinder, a slide slidably mounted on the platform car and connected with the cylinder and the legs and serving in restricting the movement of the two drive cylinders in a fixed direction.

Moreover, for locking and positioning of the ram, the hydraulic jack in another alternative form comprises a ram, a lock nut threadedly mounted on the ram, and a screw rod parallel to the ram and connected thereto via a bracket, a gear provided on the lock nut. The screw rod threadedly extends through a nut for vertical movement. A gear provided on the nut releasably meshes the gear of the lock nut.

Many other objects, features and additional advantages of the present invention will become manifest to those versed in the art upon making reference to the following description and the accompanying sheets of drawings in which a certain preferred structural embodiments of the present invention are shown by way of illustrative example.

DESCRIPTION OF THE PREFERRED EMBODIMENTS

Figure 1:
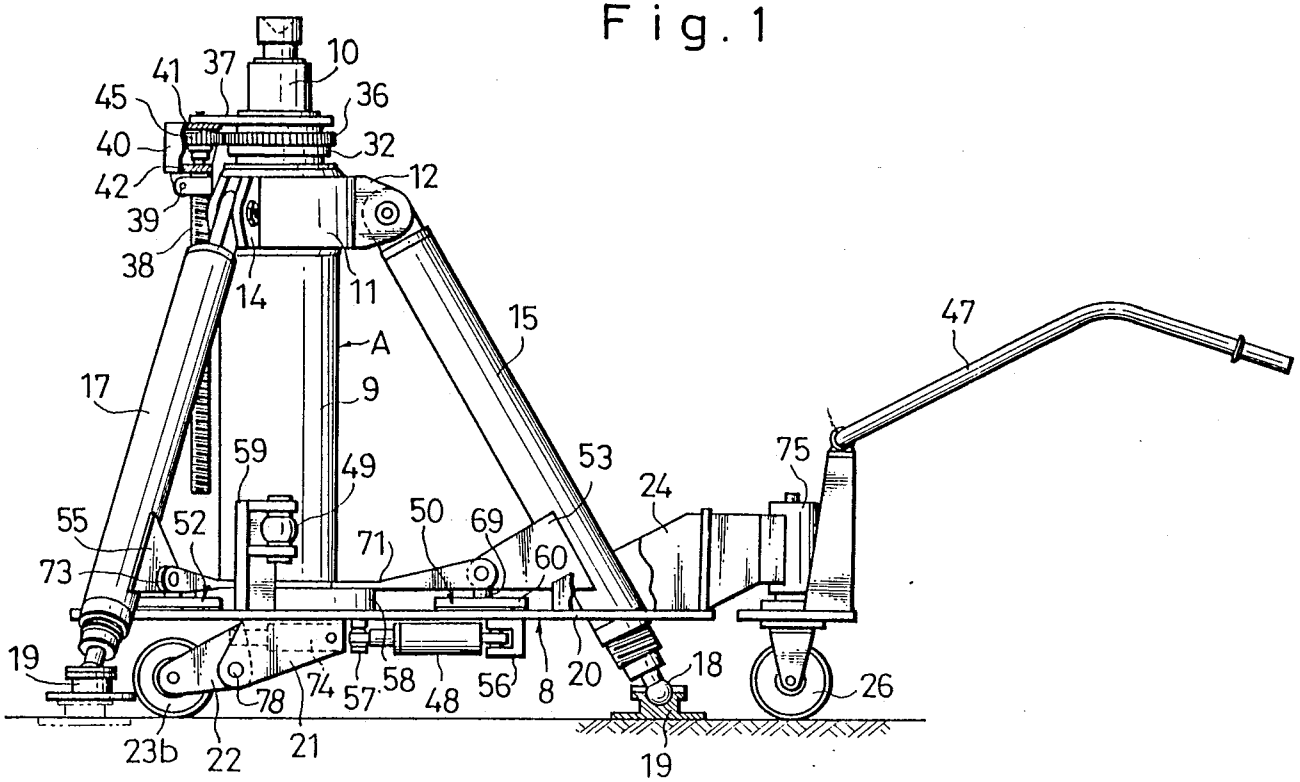
FIG. 1 is a front elevational view of a hydraulic jack embodying the present invention.
Figure 2:
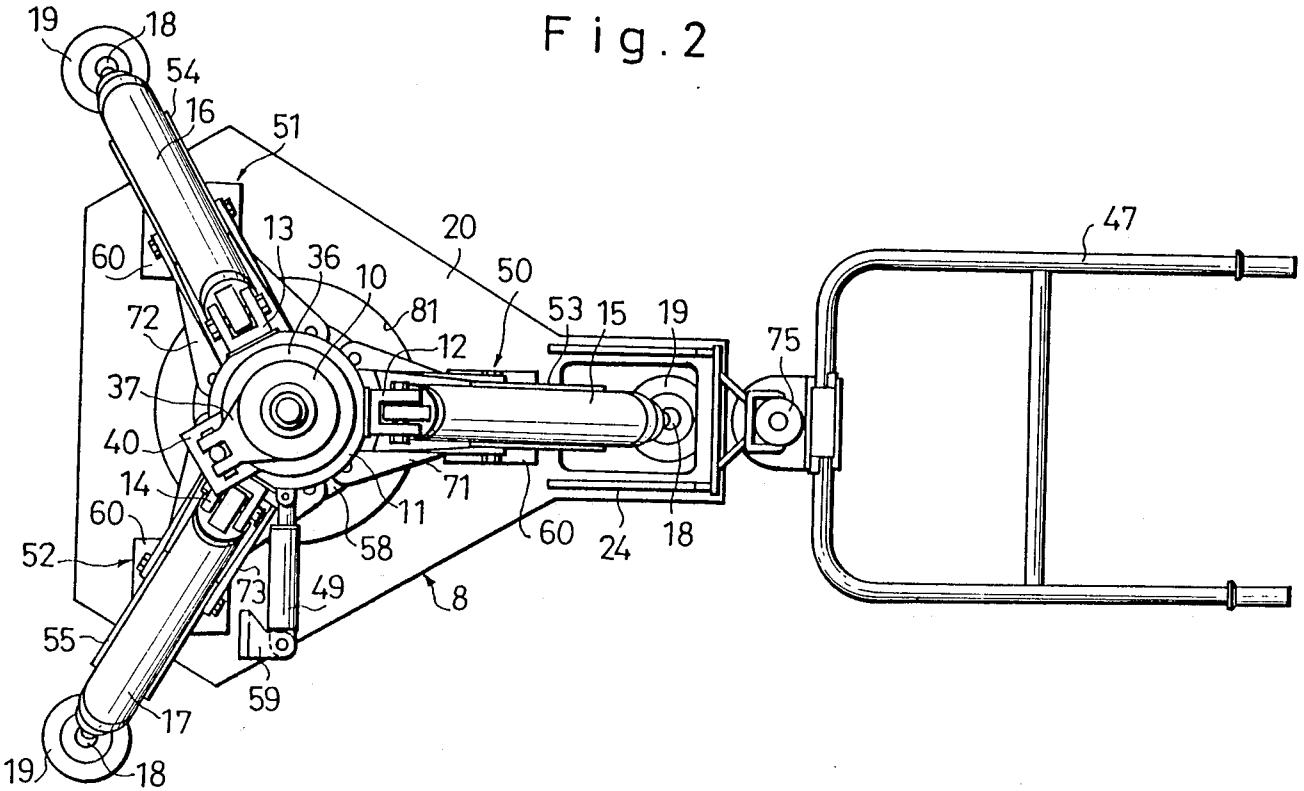
FIG. 2 is a plan view of FIG. 1.

The principles of the present invention are particularly useful when embodied in a hydraulic jack such as shown in FIGS. 1 and 2.

The hydraulic jack includes a jack body A composed of a platform car 8, a vertical primary hydraulic cylinder 9 floatingly movably supported on the platform car 8, and a ram 10 vertically movably inserted in the primary cylinder 9.

A ring 11 is mounted on an upper peripheral portion of the primary cylinder 9 and has three radially outwardly projecting brackets 12, 13, 14 to which respective upper ends of three legs 15, 16, 17 are pivotally connected. A lower end of each of the legs 15, 16, 17 is pivotally connected to a support 19 via a spherical bearing 18.

The platform car 8 includes a base 20, a pair of first casters 23*a*, 23*b* each rotatably connected to the undersurface of the base via a bracket 21, an arm 22 and a third drive cylinder 74, a lever 47 connected to the base 20 via a bracket 24 and a fourth drive cylinder 75, and a second caster 26 connected to the lower portion of the fourth drive cylinder 75. By pushing or pulling the lever 47, the entire hydraulic jack can be moved to a desired working site.

While moving the entire hydraulic jack to a working site, all of the three legs 15, 16, 17 are spaced from the ground. When the hydraulic jack arrives at a working site, such as a point under a wing of a heavy-weight airplane, the individual legs 15, 16, 17 are expanded to contact the ground to support the wing at the undersurface thereof.

Figure 3:
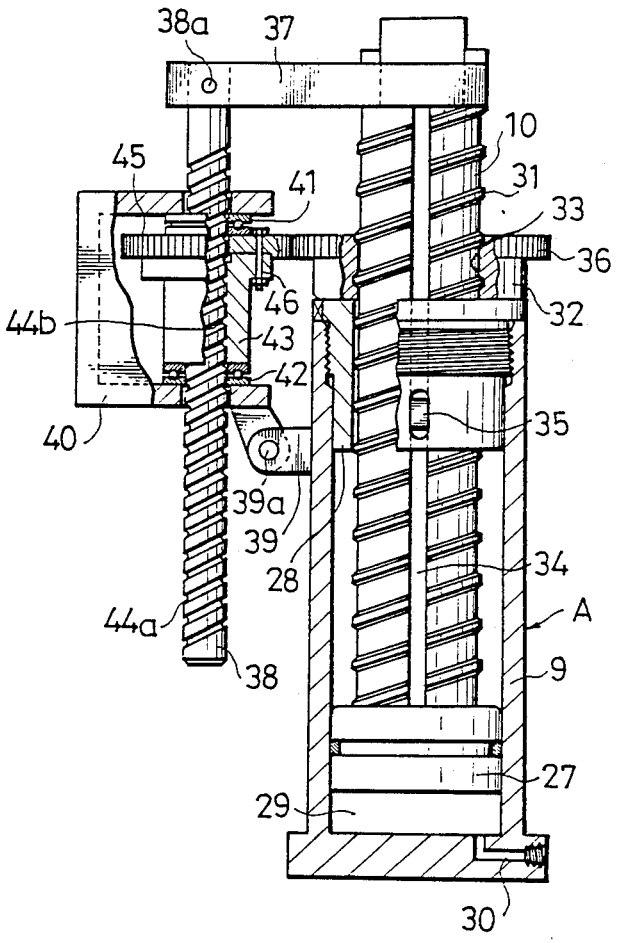
FIG. 3 is a cross-sectional view of a body of the hydraulic jack.

In the jack body A, as shown in FIG. 3, the ram 10 is vertically movably inserted in the primary cylinder 9 via a piston 27 and a cylynder head 28. The piston 27 defines in the primary cylinder 9 at a lower portion thereof a pressure chamber 29 selectively connected to a pump or a tank as an oil source.

The ram 10 has on its periphery an external thread 31 on which a lock nut 32 having an internal thread 33 is threadedly mounted, the lock nut 32 being rotatably supported on the upper portion of the cylinder head 28. The lock nut 32 serves as a stop to assist in positioning the ram 10. The lock nut 32 is provided at its upper portion with a spur gear 36.

The ram also has an axial key way 34 in which a key 35 projecting from the inner periphery of the cylinder 28 is received, guiding the vertical movement of the ram 10.

Connected to the upper peripheral portion of the ram 10 is a horizontal bracket 37 to which an upper portion of a screw rod 38 parallel to the ram 10 is pivotally connected by a pivot 38*a*.

A stationary housing 40 is releasably connected to the upper pheripheral portion of the primary cylinder 9 via a bracket 39 and a pivot 39*a*. A nut 43 is rotatably supported within the housing 40 by means of bearings 41, 42. The screw rod 38 extends vertically through both the housing 40 and the nut 43, and has on its periphery an external thread portion 44*a* meshing an internal thread portion 44*b* of the nut 43. The lead angle of the external thread portion 44*a* is larger than the lead angle of the external thread 31 of the ram 10.

A spur gear 45 is provided on the nut 43 formed integrally therewith or connected to the nut 43 by means of a screw 46, and is normally in meshing engagement with the spur gear 36 of the lock nut 32.

As compressed oil is introduced into the pressure chamber 29 via the port 30, the ram 10 is moved upwardly to bring the screw rod 38 upwardly via the bracket 37. At that time the nut 43 is rotated by the action of the external and internal threads 44*a*, 44*b*, and this rotational force is transmitted to the nut 32 via the spur gears 45, 36 to rotate the nut 32 in the reverse direction. Consequently, the nut 32 is not moved upwardly together with the ram 10 and is held in a fixed position on the cylinder head 28 while rotating.

When the ram 10 is moved upwardly to a predetermined position and stops there, the lock nut 32 is held in the cylinder head 28, thus bearing the load by the oil pressure of the pressure chamber 29 acting on the ram 10. On the other hand, when the housing 40 and the primary cylinder 9 are disconnected from each other by removing the bracket 39 or the pivot 39*a* and when the spur gear 45 of the nut 43 is brought out of meshing engagement with the spur gear 36 of the lock nut 32, rotational force of the spur gear 36 is not transmitted to the lock nut 32. Therefore, the lock nut 32 is held on the cylinder head 28 without rotation, thus preventing the ram 10 from being depressed due to inadvertent oil leak from the pressure chamber 29.

To lower the ram 10, the spur gear 36 of the lock nut 32 is again brought into meshing engagement with the spur gear 45 of the nut 43, and then high-pressure oil is returned from the pressure chamber 29 to the tank. As a result, the ram 10 is lowered by gravity. At that time the screw rod 38 is lowered, and the nut 43 is rotated in the reverse direction. Also the lock nut 32 is rotated in the reverse direction by the action of the spur gears 45, 36 so as not to interfere with the downward movement of the ram 10. Alternatively, the ram 10 may be composed of a plurality of ram members telescopically connected one to another, in which case each ram member is provided with a screw rod and a gear train in the manner described above.

Pushing or pulling the handle 47 can move the hydraulic jack to the working site under the heavy-weight structure but cannot place the hydraulic jack in an exact position vertically alleged with the point of the structure to be supported by the jack. Further, if the ground at the working site is irregular or rough, the primary cylinder 9 is subject to assume an inclined posture. Consequently, the hydaulic jack is provided with a horizontal-adjusting unit and a vertical-adjusting unit.

Figure 4:
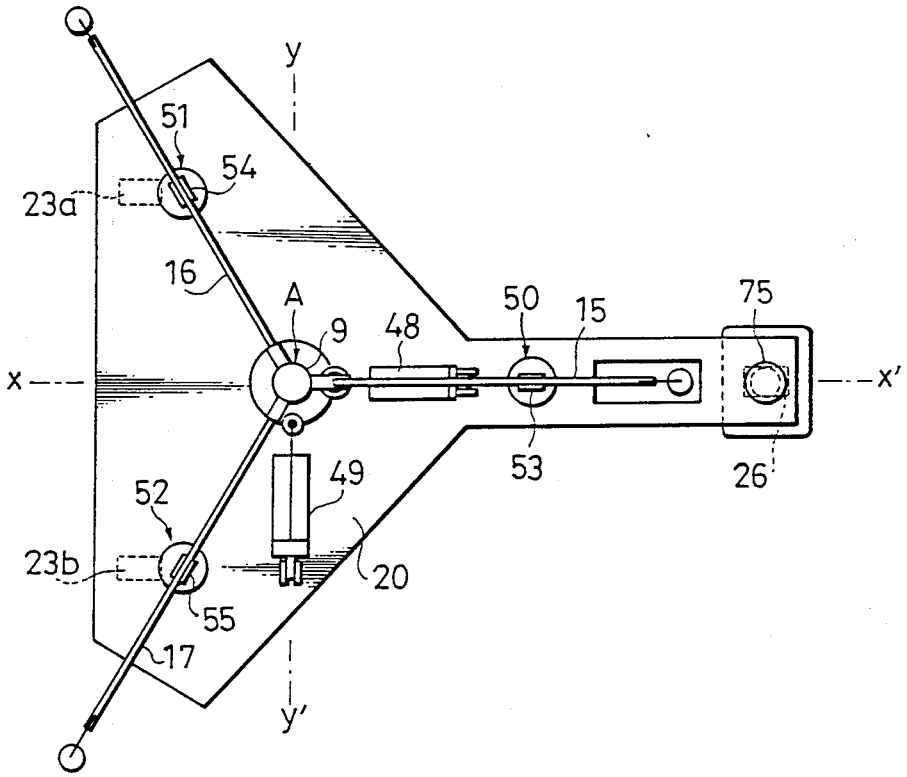
FIG. 4 is a schematic plan view of the jack, showing the principle of horizontal adjustment.
Figure 5:
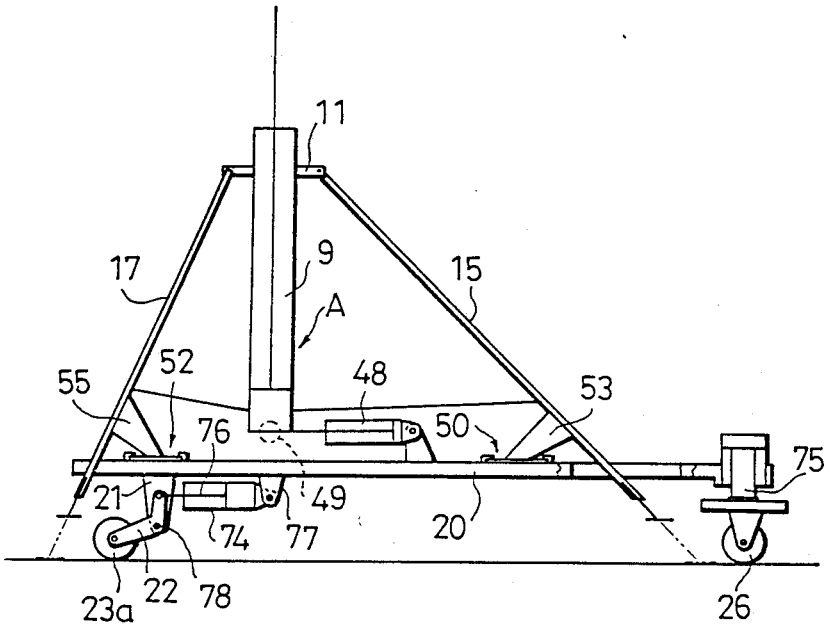
FIG. 5 is a schematic front elevational view of the jack, showing the principle of vertical adjustment.

The principle of the horizontal adjustment is illustrated in FIGS. 4 and 5. The horizontal-adjusting unit includes a pair of horizontal drive cylinders 48, 49 lying in lines X–X', Y–Y', respectively. The two drive cylinders 48, 49 are connected to the primary cylinder 9 in such a posture that the extensions of these drive cylinders 48, 49 cross each other.

The horizontal-adjusting unit also includes three slide members 50, 51, 52 supported on the base 20. Each of the three legs 15, 16, 17 is slidably connected to a respective one of the three slide members 50, 51, 51 via a bracket 53, 54, 55.

The primary cylinder 9 and the legs 15, 16, 17 are floatingly supported on the base 20. With this arrangement, as the first drive cylinder 48 is expanded in the direction of X, the primary cylinder 9 and the legs 15, 16, 17 are moved in the direction of X. As the second drive cylinder 49 is expanded in the direction of Y, the primary cylinder 9 and legs 15, 16, 17 are moved in the direction of Y. Reversely, as the first drive cylinder 48 is shrunk in the direction of X', the primary cylinder 9 and the legs 15, 16, 17 are moved in the direction of X'. Likewise, as the second drive cylinder 49 is shrunk in the direction of Y', the primary cylinder 9 and the legs 15, 16, 17 are moved in the direction of Y'.

The horizontal-adjusting unit will now be described more specifically with reference to FIGS. 1, 2, 6 and 7. The first drive cylinder 48 is horizontally mounted on the undersurface of the base 20 via a bracket 56. The piston rod of the drive cylinder 48 is connected to a bracket 57 extending through a central opening 81 in the base 20 and connected at its upper portion to a flange 58 projecting from the lower end of the primary cylinder 9. As the drive cylinder 48 is expanded and shrunk, the primary cylinder 9 is moved in the direction of X–X'.

The second drive cylinder 49 is connected at its base portion to a bracket 59 mounted upright on the base 20, the piston rod of the drive cylinder 49 being connected to the primary cylinder 9. Alternatively, the piston rod of the drive cylinder 49 may be connected to a flange of the primary cylinder 9. As the second drive cylinder 49 is expanded or shrunk in the direction of Y–Y', the primary cylinder 9 moves in the direction Y–Y'.

The three slide members 50, 51, 52 are disposed on the base 20 at equal angular distance of 120°, for example. Each of the slide members 50, 51, 52 includes a rectangular hollow frame 60 provided on its bottom a stainless plate 60', a hollow guide or slide frame 63 slidably mounted in the frame 60 via bearings 61, 62, a slider 66 slidably mounted in the slide frame 63 via front and rear bearings 64, 65 and a bottom bearing 67, and a bracket 69 mounted on the slider 66 and having a plurality of mounting openings 68 of different orientations. Each of the bearings 61, 62, 64, 65, 67 is made of a glassy material such as Teflon (trade name) pad.

The bracket 53, 54, 55 provided on the respective leg 15, 16, 17 is connected to the bracket 69 of the respective slide member 50, 51, 52 via a screw inserted through the mounting opening 68. Further, three brackets 71, 72, 73 are connected at their outer ends to the respective brackets 69 of the slide members 50, 51, 52, by means of screws extending through one of the mounting openings 68, in such a manner that the slide members 50, 51, 52 are directed toward the respective legs 15, 16, 17. When the primary cylinder 9 and the legs 15, 16, 17 are moved in the direction of X–X' or Y–Y' by actuating the drive cylinder 48 or 49, this motion is transmitted to the brackets 69 of the slide members 50, 51, 52 via the brackets 53, 54 and the brackets 71, 72, 73.

Figure 6:
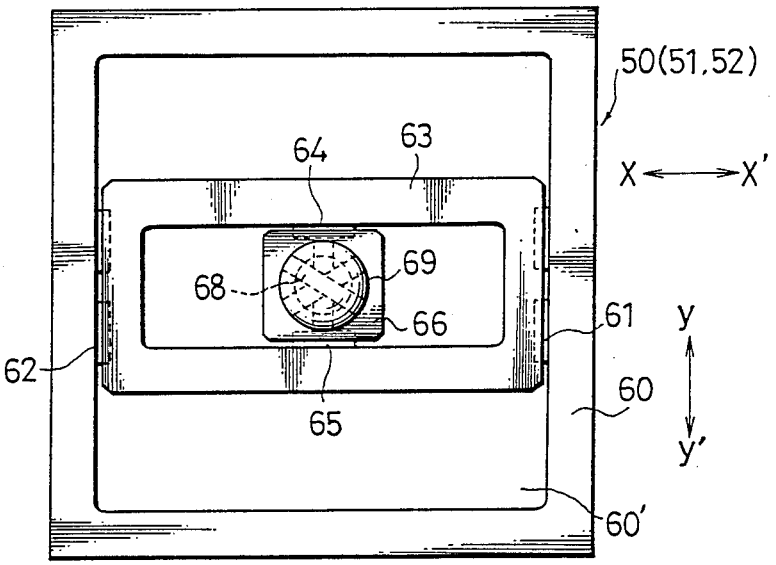
FIG. 6 is an enlarged view of a slide shown in FIG. 4.
Figure 7:
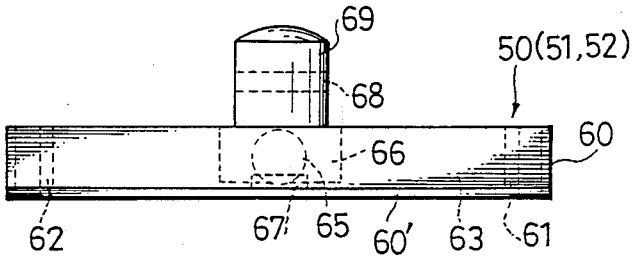
FIG. 7 is a front elevational view of FIG. 6.

For example, as shown in FIG. 6, when the primary cylinder 9 and the legs 15, 16, 17 are moved in the direction of X, a slider 66 slides in the direction of X as guided by the slide member 63. And when the primary cylinder 9 and the legs 15, 16, 17 are moved in the direction of Y, the slider 66 slides together with the slide frame 63 as guided in the directin of Y by the frame 60. When the first and second drive cylinders 48, 49 are expanded or shrunk concurrently, the primary cylinder 9 and the legs 15, 16, 17 are moved obliquely.

Having selected a desired extent to which the drive cylinders 48, 49 are expanded or shrunk, when the primary cylinder 9 and the legs 15, 16, 17 are pushed or pulled in the direction of X–X' or Y–Y' or obliquely, the slide frame 63 or the slider 66 slides in the same direction, thus bringing the primary cylinder 9 to the exact working position with fine adjustment.

FIGS. 4 and 5 also illustrate the principle of the vertical adjustment. The vertical-adjusting unit is adapted for correcting any inclination of the primary cylinder 9 to the vertical where the ground is irregular or rough.

In the vertical-adjusting unit, the casters **23*a*, 23*b*, 26 are disposed on the undersurface of the base 20 at equal angular distance of about 120°, each of the casters 23*a*, 23*b*, 26 being mounted on one end of the arm 22 pivotally connected to the respective bracket 21 by a pivot 78. The bracket 21 is mounted on the undersurface of the base 20. A third drive cylinder 74 is mounted between the other end of the arm 22 and the base 20. Therefore, as the third drive cylinder 74 is expanded or shrunk, the arm 22 is rotated via a pivot 78, causing the base 20** to move vertically.

The caster 26 is mounted on the lower end of a fourth drive cylinder 75 vertically supported on the base 20; the base 20 is moved vertically in response to expansion or shrinking of the fourth drive cylinder 75.

By adjusting the extent to which the third and fourth cylinder 74, 75, it is possible to move the base 20 and the primary cylinder 9 verically with fine adjustment.

The vertical-adjusting unit will now be described more specifically with reference to FIG. 1. Each arm 22, as a link, is pivotally connected to the end of the bracket 21 by a pivot 78, the bracket 21 being mounted on the base 20. The casters **23*a*, 23*b* are rotatably connected to the respective arms 22, 22**.

The fourth drive cylinders 74, 74 are mounted on the undersurface of the base 20 via the brackets 21, 21, and the piston rod of each fourth drive cylinder 74 is pivotally connected to the other end of the respective arm 22.

When the third drive cylinder 74 is expanded or shrunk, the arm 22 is moved from a horizontal position to a vertical position and, at the same time, the casters **23*a*, 23*b* also are moved, thus moving the base 20 vertically depending on the angle of the arm 22. The base 20 is disposed in the lowermost position when the arm 22 assumes a horizontal posture, and the base 20 is disposed in the uppermost position when the arm 22** assumes a vertical posture.

For lifting a heavy-weight structure such as a wing of an airplane, the entire hydraulic jack is moved nearly to a desired position, and then rough positioning is made under the observation with the naked eye.

Then, if the top of the ram 10 is displaced or skewed with respect to the exact working point in the direction of either X–X' or Y–Y', the first and second drive cylinders 48, 49 are actuated to correct this horizontal displacement or skew.

Further, if the base 20 and the primary jack 9 are inclined with respect to the exact working point due to the irregular or rough ground, the third and fourth drive cylinders 74, 75 are expanded or shrunk to raise or lower one side of the base 20, thereby correcting any inclination or slant of the primary cylinder 9.

After having positioned the primary cylinder 9 exactly at the working point, the individual legs 15, 16, 17 are expanded manually until the support 19 on the lower end of each leg reaches the ground, and the individual legs 15, 16, 17 are locked.

Figure 8:
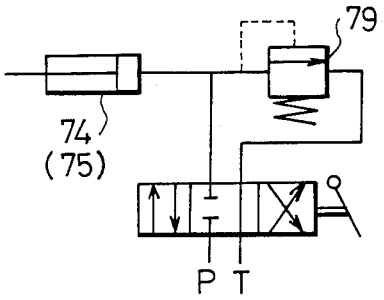
FIG. 8 is a diagram showing a hydraulic circuit.
Figure 11:
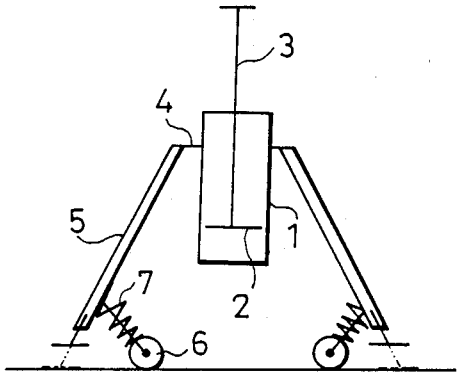
Fig. 11 (PRIOR ART)
FIG. 11 is a schematic front elevational view of a prior art hydraulic jack.

Although the ram 10 may be moved upwardly to push up the heavy-weight structure on the load-supporting point thereof, high-pressure oil of the third and fourth drive cylinders 74, 75 are returned to a tank so that no load will be exerted on the casters **23*a*, 23*b*, 26. Preferably, a relief valve 79 is connected to the hydraulic circuit of the third and fourth drive cylinders 74, 75, as shown in FIG. 8, so that no load will be exerted on the casters 23*a*, 23*b*, 26 when the individual legs 15, 16, 17 are out of contact with the ground or when the pressure oil of the drive cylinders 74, 75 has failed to be released even if the legs 15, 16, 17** are in contact with the ground.

Figure 9:
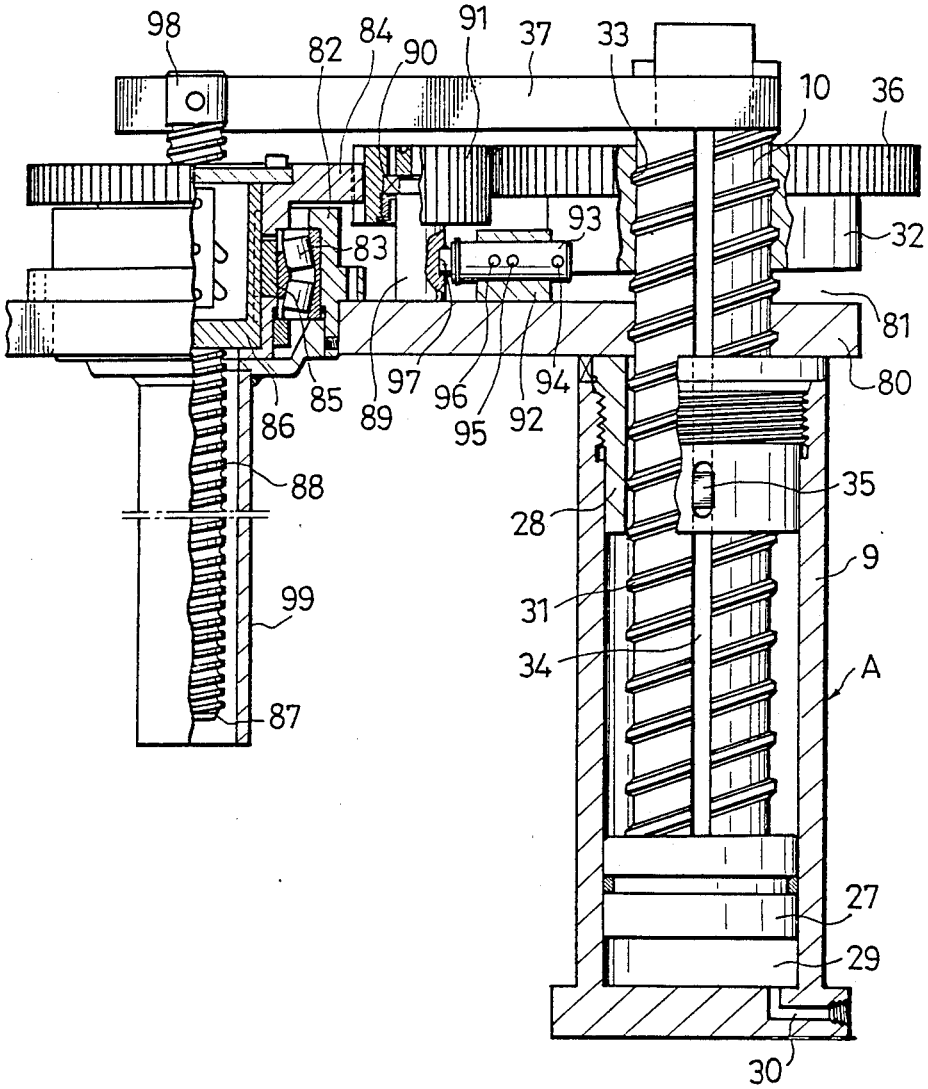
FIG. 9 is a front elevational view, with parts broken away, of a modified hydraulic jack according to another embodiment of the invention.

FIG. 9 illustrates another embodiment of the ram positioning means. In this embodiment, the construction of the hydraulic cylinders is identical with that of the cylinders of FIG. 3; therefore, like reference numerals designate similar parts throughout the views in the accompanying drawings. A support plate 80 is mounted on the upper portion of the cylinder 9, and the ram 10 extends through the support plate 80.

The ram 10 has on its periphery a male screw or external thread 31, and a lock nut 32 having a female screw or internal thread 33 which is threadedly mounted on the upper portion of the ram 10. There is an appropriate gap 81 between the lock nut 32 and the support plate 80 so that no friction will be produced between the support plate 80 and the lock nut 32 while the latter is rotating.

A housing 99 and a bearing housing 82, parallel to the cylinder 9, are mounted on the support plate 80.

A central body of a spur gear 84 is rotatably mounted within the bearing housing 82 via an automatically centering roller bearing 83, and is vertically movably connected to a nut 86 via a key 85.

Further, a screw rod or threaded shaft 87 is connected to the bracket 37 via a universal joint 98. The shaft 87 has an external thread 88 identical in direction with the external thread 31 of the ram 10 and meshing with the internal thread of the nut 86. As the shaft 87 is moved vertically, the nut 86 and the spur gear 84 are rotated as a unit.

A shaft 89 is movably mounted upright on the support plate 80, and an intermediate gear 91 is rotatably mounted on this shaft 89 via a bearing 90. The intermediate gear 91 is releasably in meshing engagement with the spur gear 36 of the lock nut 32 and the spur gear 84 of the shaft 87.

A support member 92 is mounted upright on the support plate 82 at a position near the shaft 89, and a stop 93 is movably inserted in a horizontal opening in the support member 92. The stop 93 is inserted in a locking opening 97 in the shaft 89 and is integrally joined with the shaft 89 such as by welding. The stop 93 is provided with a lever 94 and openings 95, 96. By manually pulling or pushing the stop 93 via the lever 94, the intermediate gear 91 is brought into and out of meshing engagement with the spur gear 36 of the lock nut 32 via the shaft 89. When a pin is inserted in the opening 95 to hold the stop 93, the intermediate gear 91 corotates with the lock nut 32. When the pin is inserted in the opening 96, the intermediate gear 91 is released from the lock nut 32, thus maintaining the position of the lock nut 32.

When the ram 10 is moved upwardly, the shaft 87 is raised via the bracket 37 and, at the same time, the nut 86 and the spur gear 84 are rotated via the external thread 88. The rotational force is transmitted to the spur gear 36 of the lock nut 32 via the intermediate gear 91 so as to maintain the lock nut 32 in a predetermined position.

Reversely, when the ram is moved downwardly to lower the shaft 87, the spur gear 36 of the lock nut 32 is rotated in the reverse direction via the nut 86, the spur gear 84 and the intermediate gear 91.

To determine the height of the ram 10 at a desired position and lock the ram 10 in that position, the lever 94 is manipulated to shift the stop 93 to bring the intermediate gear 91 into meshing engagement with the spur gear 36 of the lock nut 32.

With this arrangement, even if any downward load is exerted on the ram 10, the rotational force of the intermediate gear 91 is not transmitted to the lock nut 32. Therefore, even though the ram 10 and the lock nut 32 are subject to lowering by the width of the gap 81, further lowering of the lock nut 32 is restricted by the support 80.

Likewise, when any breakage in the sealing member or the tube for oil or any other failure, which requires emergency locking, occurs, the stop 93 is shifted to prevent rotation of the lock nut 32.

Figure 10:
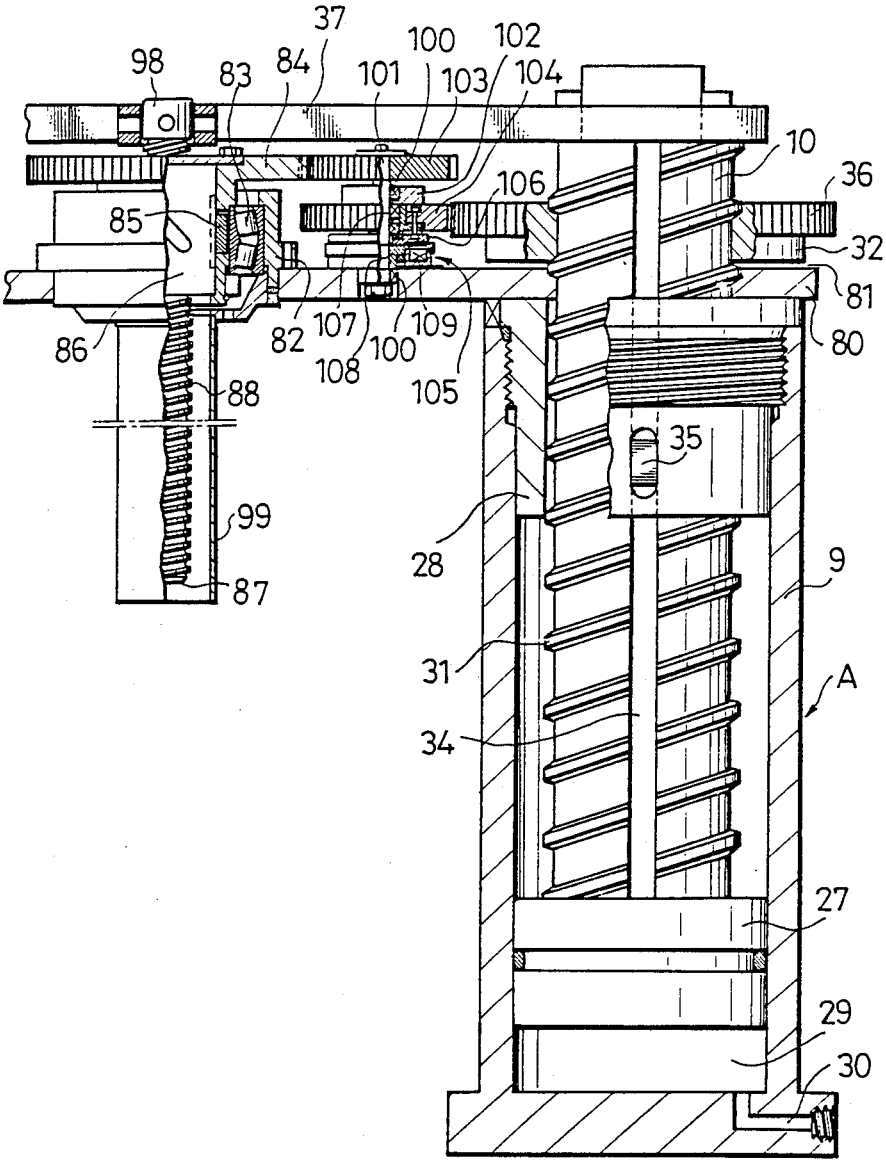
FIG. 10 is a view similar to FIG. 9, showing a further embodiment of the invention.
Figure 12:
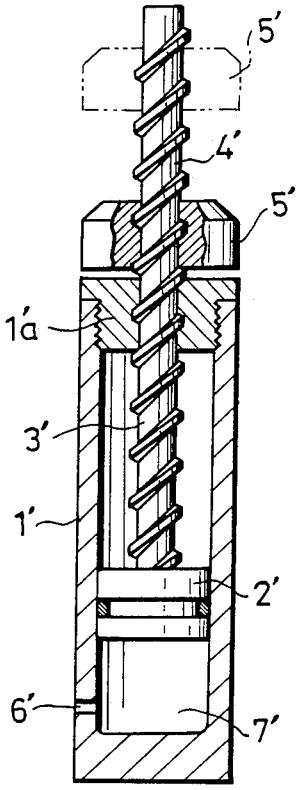
Fig.12 (PRIOR ART)
FIG. 12 is a front elevational view, partially in cross section, of another prior art hydraulic jack.

FIG. 10 illustrates a further embodiment of the ram-positioning means. According to this embodiment, the intermediate gear is replaced with two intermediate gears having an electrically operable clutch unit. The other construction of this embodiment is identical with that of the embodiment of FIG. 9; therefore, like reference numerals designate similar parts in FIGS. 9 and 10.

A shaft 101 is rotatably mounted on the support plate 80 and an arm 102 via a bearing 100, and a first spur gear 103, a second or intermediate spur gear 104 and a clutch 105 are attached to the shaft 101.

The first spur gear 103 is connected to the shaft 101 via a key, and is normally in meshing engagement with the spur gear 84 of the nut 86.

The second spur gear 104 is rotatably attached to the shaft via a bearing 107 and is in meshing engagement with the spur gear 36 of the lock nut 32.

A vertical pin is vertically movably inserted in the second spur gear 104, and a disk 106 to the attracted by a solenoid 109 is attached to the lower portion of this pin.

To move the ram 10 vertically, the solenoid 109 of the clutch 105 should be beforehand energized to attract the disk 106 to thereby connect the second spur gear 104 with a casing 108.

Accordingly, as the ram 10 is moved upwardly or downwardly, the bracket 37 and the shaft 87 are raised or lowered and, at the same time, the nut 86 and the spur gear 84 are rotated.

As the rotational force of the spur gear 84 is transmitted to the shaft 107 via the spur gear 103, the shaft 107 and the housing 108 of the clutch 105 are rotated in the same direction and, at the same time, the second spur gear 104 attracted to the clutch 105 also is rotated in the same direction, thus rotating the lock nut 32 via the spur gear 36.

To make an emergency locking during the expansion and shrinking of the cylinders, the solenoid 109 of the clutch 105 is deenergized to stop attracting the disk 106. As a result, the connection between the clutch 105 and the second spur gear 104 is released so as not to transmit the rotational force of the shaft 101 to the second spur gear 104 and the lock nut 32 so that the lock nut 32 will stop on the support plate 80 without rotation.

With the hydraulic jack thus constructed, following advantageous results can be achieved:

(A) Since the gear of the nut is rotated via the gear of the lock nut as the ram is expanded or shrunk to move the screw rod vertically, the lock nut is maintained in its original position, irrespective of the vertical movement of the ram. Therefore, it is unnecessary to vertically move the lock nut and a high degree of working efficiency can be achieved. The lock nut will not be rotated as removed from the gear of the screw rod, and the ram can be locked at a desired height.

(B) As the drive cylinders are expanded or shrunk, the platform car is directly moved vertically, or the arm is angularly moved to determine the height of the platform car depending on the angular posture of the arm, thus enabling vertical fine adjustment of the ram with respect to the exact working point. Since the drive cylinders can be remotely controlled, efficient and safe working can be achieved.

(C) Partly because two drive cylinders having respective extensions crossing each other are mounted between the platform car and the primary cylinder, and partly because the hydraulic jack body is moved in response to expansion or shrinking of the drive cylinders, it is possible to position the jack exactly at the working point. Since the jack is firstly moved nearly to the working point where the load of the heavy-weight structure is to be born, and then fine adjustment by the two drive cylinders is made, it is possible to adjust the position of the ram easily and speedily.

(D) Since the two drive cylinders mounted between the platform car and the primary cylinder are guided by the slide so as to move in a fixed direction, accurate positioning of the jack can be achieved, and rotation of the primary cylinder can be prevented.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A hydraulic jack comprising:

(a) a vertical primary cylinder;

(b) a ram vertically movably inserted in said primary cylinder and having on its periphery a first external thread;

(c) a lock nut threadedly mounted on said external thread of said ram;

(d) a first gear provided on said lock nut;

(e) a nut rotatably supported in a housing;

(f) a second gear provided on said nut and releasably meshing with said first gear of said lock nuts; and (g) a screw rod extending parallel to said ram and connected to said ram via a bracket and having a second external thread, said screw rod threadedly extending through said nut for vertical movement.

2. A hydraulic jack according to claim 1, in which said first external thread of said ram has a lead angle different from that of said second external thread of said screw rod.

3. A hydraulic jack comprising:

(a) a platform car;

(b) a plurality of drive cylinders mounted on said platform car;

(c) a jack body floatingly movably supported on said platform car;

(d) a plurality of casters mounted on an undersurface of said platform car, each of said casters being connected to a respective one of said drive cylinders for vertical adjustment of said jack body on said platform car depending on expansion and shrinking of the individual drive cylinder;

(e) a plurality of legs, each leg having an upper portion pivotably connected to said jack body and a lower portion ground engageable foot members, said legs each being extendable for engagement of said foot members with a ground surface; and, (f) bracket means for hingingly connecting said legs to said platform.

4. A hydraulic jack comprising:

(a) a platform car;

(b) a jack body floatingly supported on said platform car and including a vertical primary cylinder, a ram vertically movably inserted in said primary cylinder;

(c) first and second drive cylinders each connected at its base end to said platform car and at the other end to said primary cylinder, said first and second drive cylinders being disposed in such a manner that respective axes of said first and second drive cylinders cross each other;

(d) a plurality of legs, each leg having an upper portion pivotably connected to the jack body and a lower portion with ground engageable foot members, said legs each being extendable for engagement of said foot members with a ground surface; and, (e) bracket means for hingingly connecting said legs to said platform.

5. A hydraulic jack according to claim 1, further including first and second drive cylinders, said platform car having a central opening in vertical alignment with the axis of said primary cylinder, said primary cylinder having at its base end a flange, said first drive cylinder being connected to said platform car, said second drive cylinder being connected to said flange of said primary cylinder via said central opening.

6. A hydraulic jack comprising:

(a) a platform car;

(b) a primary cylinder vertically supported on said platform car;

(c) a ram vertically movably inserted in said primary cylinder;

(d) a jack body floatingly movably supported on said platform car and having a plurality of legs connected to said primary cylinder;

(e) first and second drive cylinders each connected at its base end to said platform car and at the other end to said primary cylinder;

(f) a plurality of slide members mounted on said platform car, each of said slide members being connected to each said leg and each said drive cylinder for guiding said first and second drive cylinders so as to move in a fixed direction;

(g) each of said slide members including a rectangular hollow frame, a slide frame slidably inserted into said rectangular hollow frame, a slider mounted in said slide frame and movable in a direction perpendicular to the direction of movement of said slide frame, said slider being connected to each of said plurality of legs and being connected to each drive cylinder via a bracket;

(h) said first and second drive cylinders being disposed such that extensions of said drive cylinders cross each other.

* * * * *